US006276912B1

(12) United States Patent
Röck

(10) Patent No.: US 6,276,912 B1
(45) Date of Patent: Aug. 21, 2001

(54) CLIMBING SHUTTERING SYSTEM FOR SUCCESSIVE CONCRETING OF HIGH VERTICAL WALLS

(75) Inventor: Ernst Röck, Amsteten (AT)

(73) Assignee: Doka Industrie GmbH, Amsteten (AT)

( * ) Notice: Subject to any disclaimer, the term of this patent is extended or adjusted under 35 U.S.C. 154(b) by 0 days.

(21) Appl. No.: 09/273,950

(22) Filed: Mar. 22, 1999

Related U.S. Application Data

(63) Continuation of application No. PCT/EP97/05220, filed on Sep. 23, 1997.

(30) Foreign Application Priority Data

Sep. 23, 1996 (DE) ..... 196 39 038

(51) Int. Cl.[7] ..... E04G 11/28

(52) U.S. Cl. ..... 425/63; 264/33; 249/20; 249/22; 249/36

(58) Field of Search ..... 425/63, 64, 65; 264/33; 249/19, 20, 22, 24, 33, 36

(56) References Cited

U.S. PATENT DOCUMENTS

| | | | |
|---|---|---|---|
| 3,973,885 | 8/1976 | Schmidt | 425/65 |
| 4,032,112 | 6/1977 | Schmidt | 254/108 |
| 4,076,778 * | 2/1978 | Whitting | 264/33 |

FOREIGN PATENT DOCUMENTS

| | | | |
|---|---|---|---|
| 597 836 B | 6/1990 | (AU) . | |
| 607 139 A | 2/1991 | (AU) . | |
| 21 54 188 A | 5/1973 | (DE) . | |
| 24 10 877 | 9/1974 | (DE) | E04G/11/28 |
| 2 318 289 | 2/1977 | (FR) . | |
| WO 90/09497 | 8/1990 | (WO) . | |

OTHER PUBLICATIONS

Customer Information Material of Aluma–Systems (10 pages, drawings, undated).
International Search Report for PCT/EP97/05220 dated Jan. 21, 1998 (3 pgs. with English Translation (2 pgs.).

* cited by examiner

*Primary Examiner*—Nam Nguyen
*Assistant Examiner*—Donald Heckenberg
(74) *Attorney, Agent, or Firm*—Fitch, Even, Tabin & Flannery

(57) ABSTRACT

The invention concerns a climbing shuttering system having a supporting structure on which various concrete shuttering elements are loaded hanging downwards. Said structure is connected at least to a first top supporting carrier that underprops it. The top supporting carrier has the means, to support it laterally to a completed wall section. The climbing shuttering system also has at least one lower supporting carrier, that can be supported on a completed wall section. There is at least one lifting device that brings about a relative movement between both supporting carriers. According to the invention, the top supporting carrier is designed to be supported on a substantially even surface. Furthermore, the shuttering elements and/or the top supporting carriers are designed in such a way that the shuttering elements can be positioned in a substantially even surface to form a shuttering and at the same time the top supporting carrier can be positioned on the shuttering elements placing them respectively against the walls.

7 Claims, 4 Drawing Sheets

CLIMBING SHUTTERING SYSTEM FOR SUCCESSIVE CONCRETING OF HIGH VERTICAL WALLS

This is a continuation of prior application No. PCT/EP97/05220, filed Sep. 23, 1997, and designating the United States of America, which is hereby incorporated herein by reference in its entirety.

The invention concerns a climbing shuttering system and a method for the successive concreting of high vertical walls.

A device for casting walls is known in the prior art from AU-B-18541/88 (acceptance no. 597836) and is viewed as the prior use subject in particular for the erection of at least two spaced and preferably parallel high walls. In the process, when using such a climbing shuttering system, the walls are erected section by section, e. g. in sections of respectively one storey in height. In this connection at first and mainly on a largely planar surface on which the walls are to be erected, a concrete shuttering consisting of a plurality of concrete shuttering elements is formed, in order to concrete a first wall section. In this context, the concrete shuttering elements are set up and stabilized with their own support and set up means.

For the erection of the further wall sections, the same shuttering elements are used, in which they are assembled with additional components to form a climbing shuttering system. This is done so that a support construction is positioned with the concrete shuttering elements and with support carriers. After the positioning by the crane, the arrangement with the support carriers, which are supported laterally in the wall sections already erected, are kept at the corresponding height. By resting on the second support carrier which is also supported laterally in the finished wall sections, after the erection of the second wall section which is located above the first wall section, the entire construction is again moved upwards. Then at a suitable height, the shuttering for a third wall section to be erected can be set up. By frequent repetition at discretion of the steps named above, high vertical walls can be erected for the formation of shafts or complete layouts.

In detail, the known climbing shuttering system therefore has a largely horizontally arranged support structure, which is connected with at least two first support carriers, the so called upper support carriers, and it is supported on them. On the support structure a plurality of concrete shuttering elements are attached hanging downwards. In addition, the support carriers have to have means by which they can be supported laterally on a completed wall section. Equally at least two second support carriers, the so called lower ones, are provided with such means. For the vertical movement of the support structure and/or for raising the lower support carrier, respectively two lift devices are provided, which make a relative movement between the top and bottom support carriers possible.

Whereas in the known system with the elements described above, the possibility of climbing, of subsequent formation of the shuttering and therefore of the successive concreting of high vertical walls is ensured, the known system cannot be used for the setting of the respectively first wall section on the largely planar surface, which is the point of departure. The reason for this is that for this purpose, the concrete shuttering elements which are suspended on the support structure have to be totally lowered onto the largely planar surface. In the area in which the concrete shuttering elements have to be lowered, however, the elements which are necessary for the support of the top support carrier, e.g. laterally pivotable pawls, are formed. These elements necessarily have to be formed below the concrete shuttering elements and aligned with them, so that during the later shuttering of a wall section on a wall section which is already present, the lateral support of the top support carrier which is located below the shuttering elements is ensured.

Because of these essential elements for the lateral support of the top support carrier, the concrete shuttering elements are consequently not lowerable onto the level of the surface on which the first wall section is to be erected. In addition, the elements in the known arrangement prevent the support carrier from being arranged at the start of the concreting work on the planar surface, in order to support the support structure with the concrete shuttering elements.

Consequently with the known climbing shuttering system there is a problem that the first wall section with the additional stabilisation and set up means has to be erected together with the shuttering elements of the climbing shuttering system. Then its own stabilisation and set up means have to be removed, and in addition in particular the shutterings used within a shaft have to be lifted out in a costly manner by use of a crane. This removal of the components and shuttering elements used for the first wall section before the erection of the climbing shuttering system and the necessity for the storage of these elements already increase to a considerable extent the costs for the erection of walls or shafts by means of the known system. Furthermore, with respect to the organisation of labour, it is extremely disadvantageous because the builders cannot be employed for the setting, reinforcement and concreting of the first wall section for the duration of the dismantling of the shutterings which were used for the first wall section. Only after the removal of the named elements and after the erection of the climbing shuttering system in the level above the first wall section, can the shuttering and reinforcement personnel again be employed. Depending on the complexity of the layout to be provided, this interruption can last from three to six weeks, and it therefore constitutes an undesirable interruption in the building cycle.

In fact there are climbing shuttering systems, the components of which can be used both for the first as well as for all the other wall sections. In this case, at first the respectively first wall section is erected. Then devices are mounted on the erected wall sections, which after the removal, draw the entire support construction with the shuttering elements into the zone above the first wall section. There the shuttering can then be set up for the second wall section and the second wall section can be concreted. After the completion of the second wall section, the lifting device is based on the second wall section, in order to bring the climbing shuttering system to the necessary height again. But in this context the lifting devices project at least one storey high above the support construction, which is usually designed in the form of a support platform. These lifting devices which project upwards are in particular an extreme impediment when supplying the concrete and the reinforcements. Especially because of the lifting devices which project upwards, there is a substantial danger of damage to these devices and an increased danger of accidents.

In the climbing shuttering system as in WO 90/09497 as well, parts of the lifting device project beyond the work platform and impede the activity in this area. In addition, in this known climbing shuttering system as well, the erection of the first wall section cannot be directly carried out on the base plate, which was the point of departure. No suitable measures for this purpose are described in the named publication. On the contrary, the work with the aid of the climbing shuttering system only begins after short starting walls have been erected on the base plate, by means of which the suspended concrete shuttering elements can be adjusted. Consequently, when using this known climbing shuttering system as well, special measures are necessary for the erection of the first wall section. In addition, the lower support carrier of the arrangement shown has to be replaced after the erection of the first wall section by a support which is suitable for climbing, which makes the device and the process carried out with it complicated.

In view of these disadvantages of the climbing shuttering systems which are known in the prior art, the object of the present invention is to create a climbing shuttering system, the components of which can be us ed both for the erection of a respectively first wall section on a largely planar surface, as well as for the erection of all the other wall sections. Furthermore, the climbing shuttering system is to be designed so that the activities which are necessary for erection of the shuttering, for applying the reinforcements and for the supply of concrete are impeded as little as possible.

These object s are achieved by a climbing shuttering system in accordance with claim 1.

Consequently, in the climbing shuttering system in accordance with the invention, at least one upper support carrier is designed for support on a largely planar surface, so that it can be positioned thereon. By this measure it is achieved that the upper support carrier which is used later for support during the climbing can already he used when erecting the first wall section on a largely planar surface to support the support structure with the concrete shuttering elements suspended from it.

In accordance with the invention in addition, the shuttering elements and/or the upper support carrier are designed so that the shuttering elements can be brought into the shuttering position on the largely planar surface and at the same time the upper support carrier can be arranged between two concrete shuttering elements which are disposed respectively on the internal sides of walls to be erected. Thereby it becomes possible in accordance with the invention by using the components which are subsequently used for climbing, to use the shuttering for the first wall section of a comparatively high vertical wall on the largely planar surface, on which the wall is to be erected. In this context the shuttering which can be positioned in accordance with the invention on the planar surface, which is used as the starting point, can be broken down at discretion in any suitable manner into individual shuttering elements. For example, it is conceivable that laterally on the upper support carrier, comparatively small shuttering elements which are in particular strip shaped can be formed, which together with the shuttering elements above them of larger surface, form the shuttering for the first wall section.

In accordance with the invention, after the erection of the first wall section, the support construction with the concrete shuttering elements suspended on it and with at least one upper support carrier can be moved for at least a certain distance upwards. By using the intermediate space which is formed between the top support carrier and the largely planar surface, at least one upper support carrier can be moved or provided in such manner with suitable means or elements that it can be supported during the subsequent climbing process laterally on the wall sections which have already been erected. Optionally, the small shuttering elements which are present laterally on the upper support carrier should be removed in advance. Alternatively or additionally, the concrete shuttering elements can be moved vertically so that the means or elements for the lateral support of the upper support carrier arrive in positions, in which they can develop their effect for lateral support of the upper support carrier.

According to a preferred embodiment, the upper support carrier has its own elements for the lateral support on a completed wall section, which are pivotable around a largely horizontal axis. By pivoting around the axis, the named elements can be brought into a position in which e.g they engage in recesses in the wall sections already erected and thereby support the upper support carrier. In accordance with the invention these elements can be mounted to be removable on the upper support carrier. In particular, these elements during the erection of the first wall section on the planar surface are not yet mounted on the upper support carrier, in order not to prevent, as mentioned above, the positioning of the upper support carrier on the largely planar surface, and in order not to collide with the shuttering elements which are in a shuttering position on the planar surface during the erection of the first wall section.

As mentioned above, after the erection of the first wall section on the planar surface, the entire arrangement is moved vertically. By the removable mounting of the elements described, they can be applied without problems subsequently in the area below the shuttering elements and the upper support carrier. For example, this can concern laterally pivotable pawls, which can be pivoted outwards in a zone below the shuttering element which is in contact with t he upper support carrier, in order in the upper zone of an already erected wall section to ensure the support of the upper support carrier, when the shuttering is established by means of the concrete shuttering element above it, and the next wall section is erected.

In accordance with another preferred embodiment, the shuttering elements can be raised and lowered on the support structure. Thereby it is made possible advantageously that the shuttering elements, after the erection of the first wall section on the largely planar surface, can be moved slightly upwards in the vertical direction, in order then to mount or to remove suitable elements laterally on the upper support carrier and below the raised concrete shuttering elements, by means of which the upper support carrier is laterally supported during climbing.

For example, in accordance with a further development of this preferred embodiment, the upper support carrier can be designed to be laterally movable at least in sections. Thereby after the above mentioned raising of the concrete shuttering elements, individual parts of the upper support carrier can be moved out laterally so that by means of these components, a lateral support of the upper support carrier can be achieved.

In addition, for this embodiment of the invention it is preferred that the upper support carrier is provided with elements which are pivotable for its lateral support around a largely horizontal axis. In accordance with this preferred embodiment, the elements for lateral support are arranged in an upper zone of the support carrier so that they can be pivoted inwards during the arrangement of the upper support carrier on the largely planar surface between the shuttering elements which are lowered to achieve a shuttering position. After the erection of the first wall section on the largely planar surface, the shuttering elements are then raised by at least a small amount, so that in the zone below the raised shuttering elements, the above mentioned elements for lateral support of the upper support carrier can be pivoted out. After the movement of the totality of the arrangement to a height at which the shuttering is erected for a further wall section, the pivotable elements can be pivoted out laterally into recesses in the wall section which has already been erected, whereby simultaneously the concrete shuttering elements are in a suitable position for the erection of a wall section above the wall section which has already been completed.

According to another preferred embodiment of the invention, the support structure and the upper support carrier are connected with each other to be height adjustable. Preferably a height adjustable mounting is provided in addition for the lift device. In this embodiment, the inventive climbing shuttering system can be used in an advantageous manner flexibly for various storey levels. This is because the maximal height of the wall section which can be erected with the climbing shuttering system is determined by the distance between the upper support carrier, which is supported on the wall section below it and the support structure, on which the shuttering elements are appended hanging downwards. Due to the height adjustable connection between the upper support carrier and the support structure, this spacing and therefore the storey height to be provided can be adjusted. In this connection it should be mentioned that this measure is also suitable for a climbing shuttering system, which consists solely of the support structure, the concrete shuttering elements, the upper support carriers, the lower support carriers and the lift devices, and consequently it is suitable especially for the erection of wall sections in the course of the climbing process. With the named design, for such a climbing shuttering system, outstanding flexibility can be achieved for the erection of high vertical walls with storey heights which are to be selected differently.

In accordance with a further aspect of the invention, a process is suggested for successive concreting of high vertical walls, in which for the erection of a first wall section on a largely planar surface and of all the wall sections above it, the same components of a shuttering climbing system can be used.

Accordingly at least one upper support carrier which has means by which the upper support carrier can be laterally supported on a completed wall section or can be mounted on such means, is arranged on a largely planar surface. Then a support structure is arranged above it and supported on the support carrier. On the support structure, a plurality of concrete shuttering elements is provided hanging downwards, so that they can be brought into shuttering position on the largely planar surface, in which they are arranged respectively adjacent to the upper support carrier. For the subsequent movement of the totality of the arrangement, in addition at least one lifting device is disposed between the support structure or the upper support carrier and the largely planar surface and it is secured on the named elements. Optionally at the same time as the step named above, a first wall section can be reinforced on the largely planar surface. Furthermore, at a suitable point in time, the concreting work for the first wall section can be carried out.

After the erection of the first wall section and the set up of the concrete shuttering elements by at least minor horizontal displacement, the support structure with the concrete shuttering elements and the upper support carrier are moved vertically by at least one lifting device. Then at least one lower support carrier is applied on the bottom end of the lifting device. Optionally simultaneously with this step, the upper support carrier and/or the position of the shuttering elements can be changed with respect to the upper support carrier so that the means of the upper support carrier for lateral support on a completed wall section can be arranged below an adjacent concrete shuttering element. This alteration in accordance with the invention of the upper support carrier can e.g. be the application of pivotable elements for the lateral support of the upper support carrier. Alternatively, in the course of this step, the shuttering elements can be raised. In this case, it is preferred for the upper support carrier that it should be moved out laterally section by section.

After these completion measures on the climbing shuttering system which is used, the total arrangement is moved to a level at which the upper support carrier can be supported in the top zones of the completed wall sections. In certain circumstances, after carrying out the necessary reinforcement and shuttering work, a further wall section can be concreted above the finished wall section. Optionally at the same time as the step named above, the lower support carrier is moved to a height at which it can also be supported laterally in the upper zones of the finished wall section. In accordance with such an arrangement of the lower support carrier, the movement of the entire arrangement upwards by support on the lower support carrier can be repeated frequently at discretion to erect a shuttering for a further wall section as well as for the following steps, in order to concrete vertical walls or shafts up to a desired level. It should be mentioned that during reinforcement, shuttering and concreting work for a predetermined wall section the entire system can be supported on the lower support carrier, which is supported on the second wall section below it. Consequently for support in this case, it is not the upper support carrier which is used, and which has to be supported on the wall section directly below it, the concrete of which is still newer and under certain circumstances may not yet have the necessary strength. Because of this measure, in certain circumstances an acceleration of the timing can be achieved.

BRIEF DESCRIPTION OF THE DRAWINGS

Below an embodiment of the invention shown in the drawings will be described in more detail. The drawings show.

Figure 1:
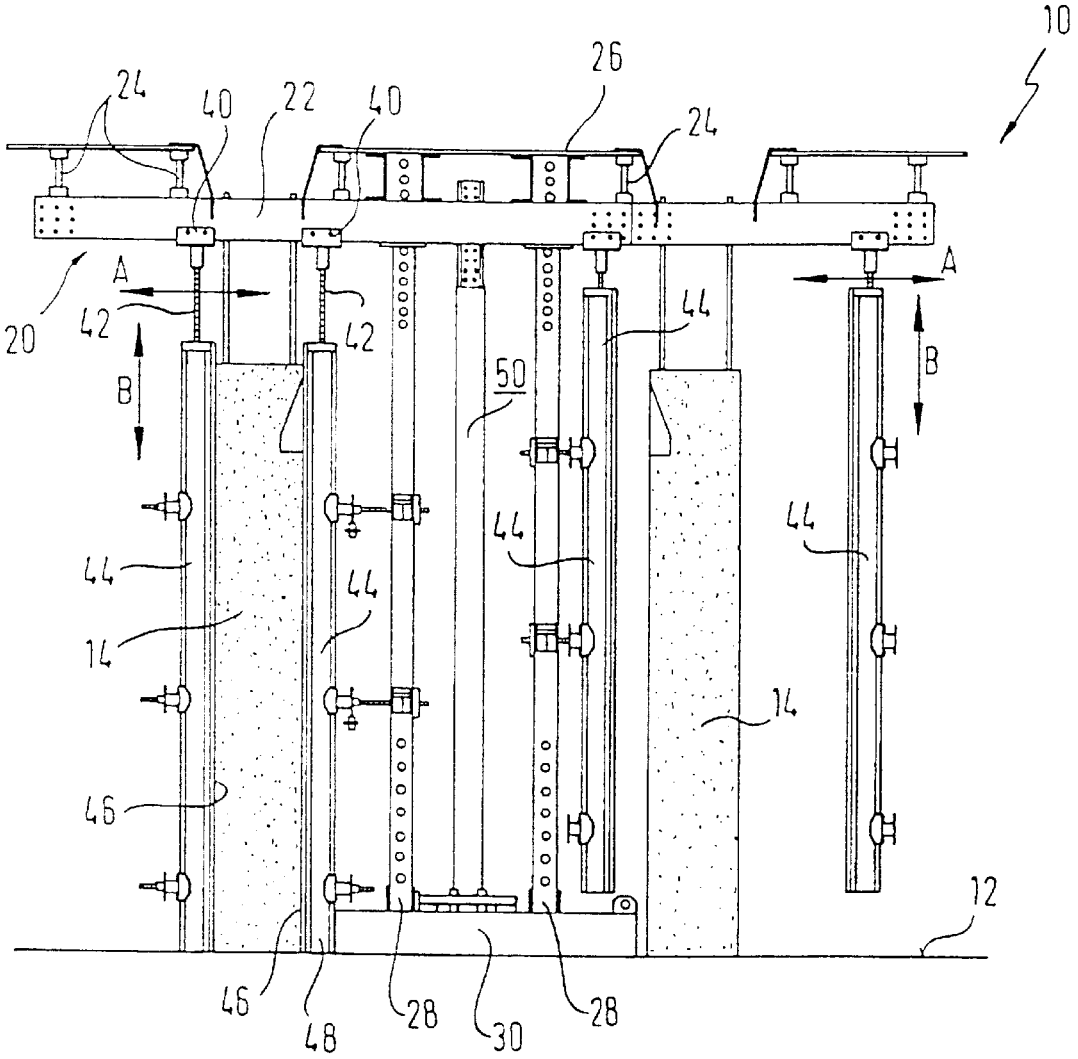
FIG. 1 a side view of the inventive climbing shuttering system which is positioned to erect a first wall section on a planar surface.

In the position shown in FIG. 1, individual components of the climbing shuttering system 10 are arranged for the erection of two vertical walls 14 on a planar surface 12. In detail, the climbing shuttering system 10 consists of a support structure 20 which is composed of capping pieces 22, which extend transversely in the drawing of FIG. 1, and on which cross supports 24 are arranged, which extend perpendicularly to the plane of the drawing in the FIG. 1. The capping pieces 22 and the cross supports 24 form to some extent a profile grid, on which a platform 26 can be formed by suitable elements. This platform is the main working surface in the inventive climbing shuttering system, which is used for the introduction of the reinforcements, the concrete, the positioning of work instruments such as vibrators and welding devices, as well as the bearing surface. In particular, in the sense of a "co-growing site" one or more containers can be arranged on this platform, in which social and sanitary devices as well as offices can be accomodated.

The largely horizontally arranged support structure 20 is connected by two beam profiles 28 by a first so called upper support carrier 30 and is supported on it over the beam profiles 28. As can be seen in FIG. 1, the beam profiles 28 are designed with suitable bores so that the height between the support structure 20 and the upper support carrier 30 can be adapted in accordance with the requirements, e.g to a given storey height. In the case which is shown, the support structure 20 is therefore connected to be height adjustable with the upper support carrier 30. A height adjustable mounting of the lifting device 50 which is described below can be seen in its upper zone.

On support structure 20, and in the case shown, on the capping pieces 22 a plurality of shuttering elements 44 is attached hanging downwards by connecting elements 40 and spindles 42. In the case shown, only the shuttering elements 44 are to be seen, which are attached on the capping pieces 22. But it is understood that in particular for the establishment of shutterings for the wall which extend transversely to the walls 14 which are shown, shuttering elements 44 can be present, which hang from the cross supports 24. As indicated by arrow A in FIG. 1, the shuttering elements 44 are movable in the horizontal direction by rollers on the connecting elements 40. This movement on the one hand is necessary for the stripping of the shuttering elements 44 from a completed wall 14 and on the other hand for the formation of a sufficiently large intermediate space between the shuttering elements 44 and the reinforcements which are to be mounted in the zone of a wall to be erected. In this intermediate space, e.g a worker must be able to enter, to carry out the necessary work. It is shown respectively in the drawing that the shuttering elements 44 are mounted on the capping pieces 22 so that the shuttering elements 44 can be moved in the longitudinal direction of the support. However, by using suitable intermediate elements, it is easily conceivable that the shuttering elements 44 can also be suspended to be movable in a direction perpendicular to the supports on which they are mounted.

In the case shown in FIG. 1, the shuttering elements 44 of the lefthand wall 14 which is shown are adjustable by suitable elements from the beam profiles 28. In the position shown for the two shuttering elements 44 which are arranged on the lefthand wall, by means of the named components of the inventive climbing shuttering system 10, a wall 14 can be erected on the planar surface 12. To do this, the shuttering elements 44 are placed directly on this surface 12. The shuttering elements 44 which are respectively in a shaft formed by the two walls 14 are adjacent to support carrier 30, which is inventively designed so that the total system can be supported in the position shown above the so called upper support carrier 30 on the largely planar surface 12. In particular, for the formation of a shuttering for the erection of a wall 14 on surface 12 at least the shuttering skin 46 of shuttering element 44 fits next to the lateral edge of support carrier 30. As can also be seen in FIG. 1, the shuttering elements 44 also consist of vertical supports 48, which provide sufficient strength of the shuttering elements 44, and between which the edges of support carrier 30 which extend furthest laterally are arranged.

For the wall shown on the right in FIG. 1, a situation is illustrated in which the shuttering elements 44 are raised to prepare for the climbing process by spindles 42 in the direction of arrow B. In addition, the shuttering elements 44 have been moved for stripping in the horizontal direction respectively by a distance in the direction of arrow A. By this position of shuttering element 44, vertical movement of the entire climbing shuttering system 10 becomes possible, which is effected by a lift device 50.

Figure 2:
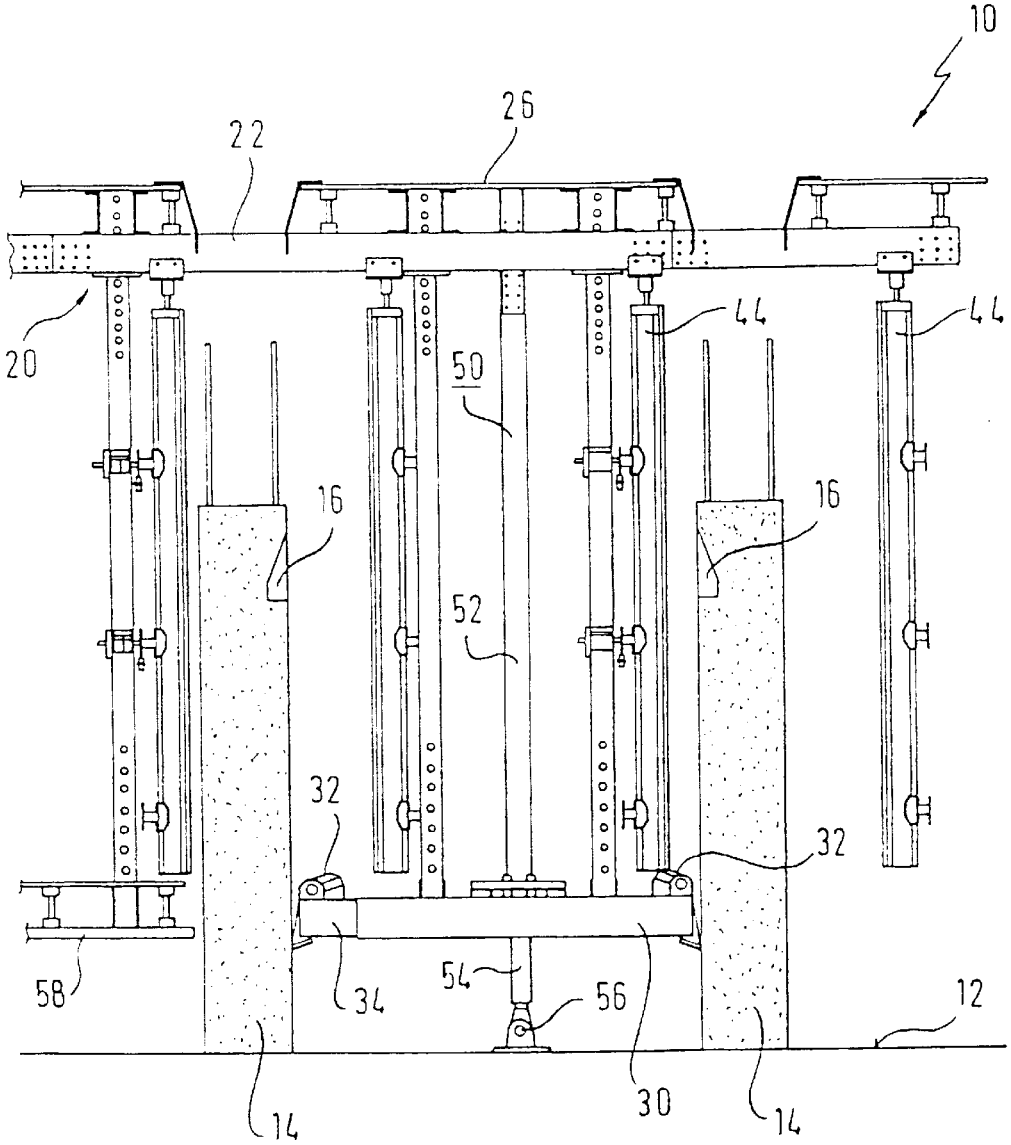
FIG. 2 a side view of the inventive climbing shuttering system which is raised a little for the changes to-he made for the climbing process.

In FIG. 2, a situation is shown in accordance with a vertical movement of the climbing shuttering system 10 by a comparatively small amount, e.g. 50 to 100 cm upwards. As can be seen in FIG. 2, the lift device 50 consists of a lift cylinder 52, which in the case shown is firmly connected to support structure 20. Furthermore, the lift cylinder 52 is guided in the support carrier 30, but it can also be firmly connected with support carrier 30, to raise the total arrangement with the shuttering elements 44.

The raising is carried out by the extension of a lift piston 54, e.g. by hydraulic means, downwards. The lift piston 54 is supported above a base 56 on the planar surface 12, and consequently on extension it presses the lift cylinder 52 and the components attached to it upwards.

A first vertical movement of the climbing shuttering system 10 by a comparatively small amount upwards is necessary to be able to carry out changes on the shuttering elements 44 and / or the upper support carrier 30, which make possible for the climbing process to be carried out later a lateral support of the support carrier 30 in the already completed wall sections 14. In the case shown, to do this, the shuttering elements 44 are raised before the vertical movement of the climbing shuttering system 10. In addition, in the case shown the vertical movement of the total arrangement was also necessary to mount the pawls 32 on the support carrier 30, said pawls 32 being pivotable around a horizontal axis, and by means of which the support carrier 30 can be supported laterally in walls 14.

The pawls 32 are so called gravity pawls, in which the weight is distributed around the pivotable axis, so that the pawls project section by section laterally from the support carrier 30, as long as no other forces take effect on them.

In the situation shown in FIG. 2, the pawls 32 are kept by the adjacent walls 14 e.g. in a largely restricted position. But as soon as during movement, the recesses 16 to be seen in the upper zones of walls 14 are reached, the pawls 32 pivot laterally outwards due to the above mentioned weight distribution, so that support carrier 30 can be supported above them, as will be described below in more detail.

Figure 3:
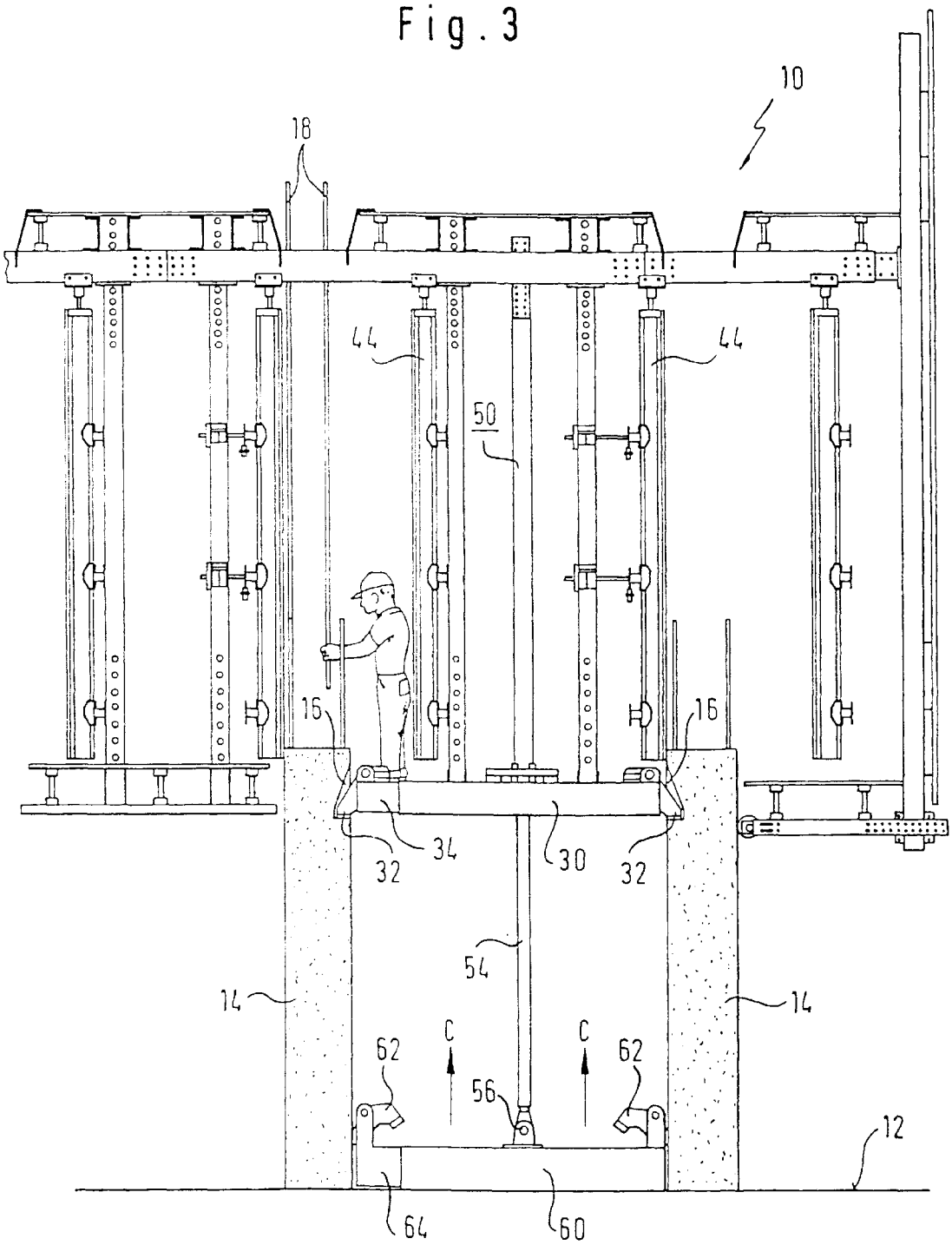
FIG. 3 a side view of the inventive climbing shuttering system in a position in which the shuttering for a second wall section can be erected.

Apart from pawls 32, other components can be attached in the position of the climbing shuttering system 10 shown in FIG. 2. In FIG. 2 e.g. a work platform 58 which is secured to the left of the lefthand wall hanging from support structure 20 can be seen. In addition, e.g. facade profiles, outer platforms and wind shelters can be mounted on the outsides of the walls 14. In FIG. 3, such elements are shown in the righthand zone. Consequently the righthand zone shown in FIG. 3 is the outside of a shaft to be erected. In FIG. 3 it is shown e.g. for the lefthand zone that for the left side of the lefthand wall 14 a further shaft can be present, in which there are no lift devices. On the contrary, the shuttering elements 44 and the optional work platforms are raised together with support structure 20, when by means of the lift device shown in the middle zone of FIG. 3 and other lift devices, the support structure 20 is moved.

In FIG. 3 it can also be seen that setting out from the position shown in FIG. 2, after the application of the pawls 32 on the upper support carrier 30, the total arrangement is moved to a level in which in the zone of the upper support carrier 30 suitable recesses 16 are formed on walls 14, into which the pawls 32 can be pivoted for support of the support carrier 30. In the position shown in FIG. 3 of the climbing shuttering system 10, the implementation of the work necessary for shuttering a further wall section and for the application of the necessary reinforcements 18 is possible, as is indicated for the lefthand wall 14. It should be noted that for the insertion of the reinforcements, only one of the shuttering elements 44 has to be moved respectively out of a pair of shuttering elements 44 to such an extent that in this zone a worker can enter and move the reinforcements into position. In the same way, both shuttering elements 44 can be mounted on support structure 20 so that they can be moved a corresponding distance.

At the same time as this work and with a great saving of time, the inventive shuttering climbing system 10 can be completed by the attachment of the bottom support carrier 60 on the base 56 of the lift device 50. For this purpose the lift piston 54 is raised a little with the base 56 firstly in the direction of arrow C. Then on the base 56 the lower support carrier 60 is secured, which to the extent that the walls 14 are the walls of a shaft which is closed on all sides, can be introduced e.g. via shaft apertures, such as access doors to lift shafts.

As can be seen in FIG. 3, the lower support carrier 60, like the upper support carrier 30, has pawls 62 which in the situation shown in FIG. 3 are held in a pivoted position through the walls 14, and which furthermore pivot outwards laterally due to their weight distribution on reaching suitable recesses, to achieve a support of the lower support carrier 60. In the example which is shown, the lower support carrier 60 has a pusher part 64, which is used for adaptation of the width of the lower support carrier 60 to the spacing of the walls 14 which are to be erected. In the same way, in the case shown, the upper support carrier 30 can also be provided with a pusher part 34, which can be used apart from adaptation to the width, and also for the extension of the support elements, e.g. of the pawls 32, after the raising of the shuttering elements 44.

After the mounting of the lower support carrier 60 on the lift device 50, the inventive climbing shuttering system 10 is complete for carrying out the climbing process. To do this, firstly the lower support carrier 60 is moved upwards in the direction of arrow C, as far as suitable recesses 16, in which the lower support carrier 60 can be supported laterally. After completion of further wall sections above the walls 14 which are shown in FIG. 3, the arrangement consisting of the upper support carrier 30, beam profiles 28, support structure 20 and shuttering elements 44 can be moved to a height at which a third wall section is to be erected. To do this, the entire arrangement is supported on the lower support carrier 60.

Figure 4:
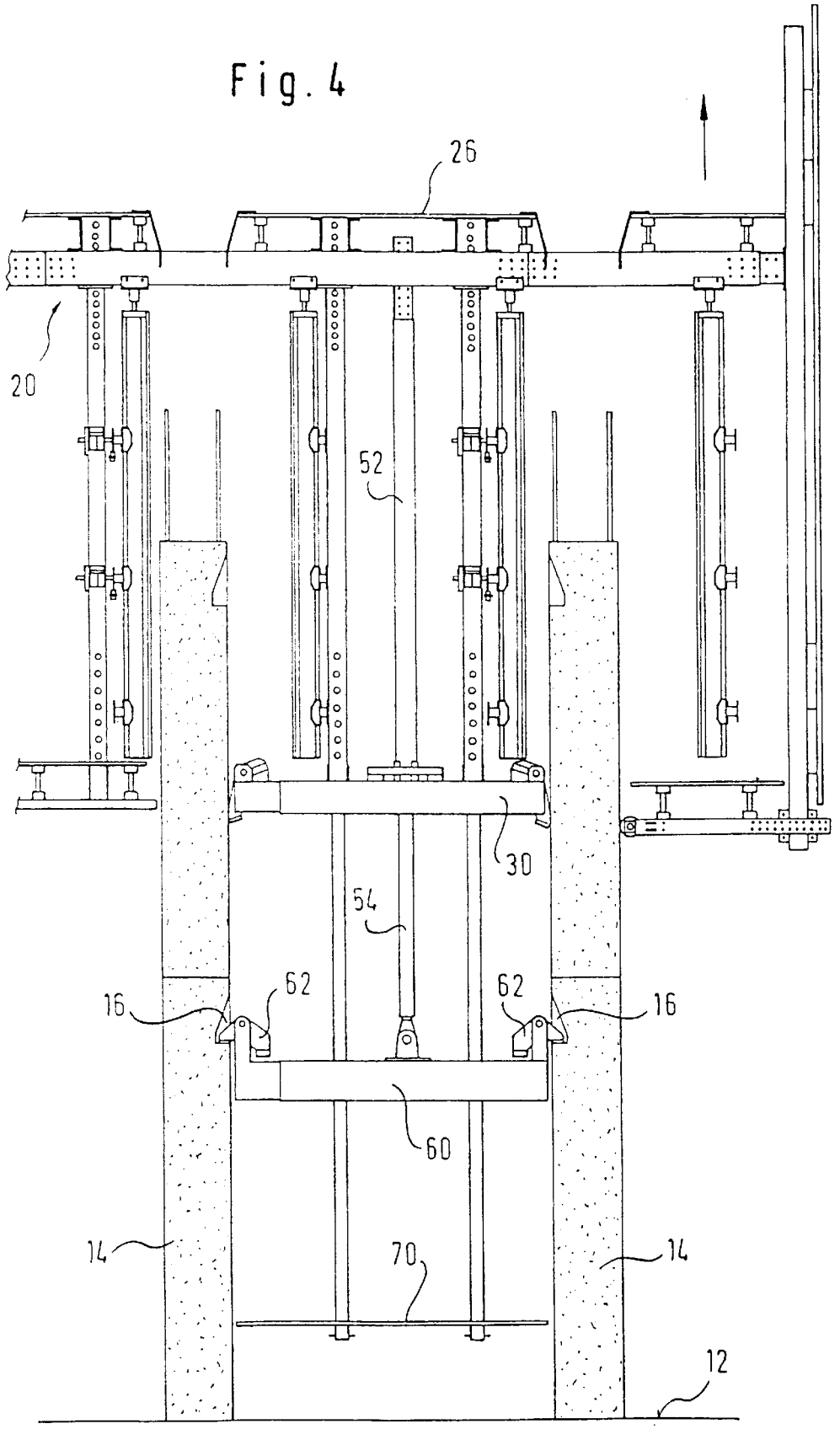
FIG. 4 a side view of the inventive climbing shuttering system during movement into a position for erecting a shuttering of a further wall section.

FIG. 4 shows the situation when moving the arrangement. In the case shown, recesses 16 are formed in the upper zones of walls 14, so that they can also be used to support the lower support carrier 60 over the laterally pivotable pawls 62. It is also conceivable that suitable recesses or suitable devices can be designed for the support of the lower support carrier 60 separately from the recesses 16 shown above the upper support carrier 30. These separate recesses or devices for the lower support carrier 60 can be formed, in particular, on a different level and/or laterally by the recesses for the upper support carrier 30, when the lower support carrier is correspondingly designed and/or arranged.

Therefore after the lower support carrier 60 has been moved upwards by the induction of the lifting piston 54 into the lift cylinder 52, the pawls 62 pivot outwards laterally into recesses 16. By the subsequent extension of the lift piston 54 out of the lift cylinder 52, the whole arrangement is pressed by the support on the lower support carrier 60 to the necessary height. Then the process steps described can be carried out as often as desirable, to form vertical walls or shafts with the desired height. Given a suitable design of the support structure 20 and by the use of a plurality of upper and lower support carriers 30, 60 and the other necessary components of the inventive climbing shuttering system 10, it is also possible to concrete the entire base plan of a building in the necessary level. In the case shown, below the upper support carrier 30 there is also a further working plate 70.

From the specification of the inventive climbing shuttering system 10, it is clear that due to the arrangement of the lift device 50 below the support structure 20, at no time do individual components of the climbing shuttering system 10 project beyond the platform 26 of support structure 20, which in the system known in the prior art impede the work, especially when filling the shutterings with concrete. In addition, in the inventive climbing shuttering system 10 the advantage is achieved that the same components of the system which are used for the climbing process can also be used for the erection of the shuttering for the first wall section on the planar surface 12 which serves as the starting point. Then in accordance with the invention the climbing shuttering system 10 is modified so that the individual components can fulfill their function during the climbing process. At the same time as this completion of the climbing shuttering system 10, the shuttering and reinforcement work can be carried out for the second wall section. Therefore the interruption of the work of the shuttering and reinforcement personnel which cannot be avoided in the climbing shuttering systems known from the prior art no longer takes place due to the removal of the shuttering elements for the first wall section. In addition, for the work which is necessary for the erection of vertical walls, such as reinforcement and concreting, it is not impeded by any elements which project in the known climbing shuttering system beyond the support structure 20. Thereby better, safer implementation of this work is achieved with little risk.

Concerning the pawls for the lateral support of the two support carriers 30, 60 it should be noted that it is also conceivable that they should be forced by suitable springs into a pivoted position from which they are also forced into a restricted position through the walls as in the case of the gravity pawls shown in the drawings. In addition, on walls 14, instead of the recesses 16 or in addition to them, their own devices can be attached, by means of which the support carriers 30, 60 can be supported by suitable elements. In addition, instead of the pawls, any extensible elements can be provided to ensure the lateral support. The extension can e.g. be carried out steplessly by spindles, and the extensible elements can be designed to be stopped in certain positions. Equally the lateral supports of both support carriers can be provided by suitable components which are rotatable around a vertical axis and consequently are rotated out to support the support carriers and on movement of the support carriers, can be rotated within the lateral edges of the support carriers.

These can be e.g. so called receptor shoes which are anchored on the wall or are sunk in suitable recesses in the wall. Such receptor shoes would in this case have the pivotable, displaceable or rotatable elements which are provided in accordance with the preferred embodiment of the invention for the support carriers. The named elements would then have to be designed so that the respective support carriers can be moved past these elements in the zone directly above the elements, in order then to be slightly lowered so that suitable formations on the support carriers come to engage with the named elements to support the support carriers. It is understood that the above named embodiments of the support devices on the upper support carrier and/or on the already erected wall sections can be used in the same way for the support of the lower support carrier.

What is claimed is:

1. A climbing shuttering system comprising:

a largely horizontally arranged support structure, on which a plurality of concrete shuttering elements are appended hanging downwards;

at least one first, upper support carrier, on which the support structure is supported, and having elements, by which the upper support carrier is vertically supportable by lateral contact between two completed wall sections which are spaced from each other;

at least one second, lower support carrier below the upper support carrier having elements on which the lower support carrier is vertically supportable by lateral contact between the two spaced and completed wall sections;

at least one lift device to provide a relative movement between the upper and the lower support carrier; wherein the upper support carrier is designed for support on a largely planar surface, so that the upper support carrier is positionable on such a surface, the shuttering elements and the upper support carrier are designed so that the shuttering elements are positionable to form a shuttering for at least two opposite wall sections on the largely planar surface, the upper support carrier is arrangeable between the shuttering elements which are in the shuttering position inside the wall sections which are to be formed, so that the shuttering elements are at least slightly movable in the horizontal direction with this arrangement of the support carrier, and the lower support carrier is mountable, when the upper support carrier is supported on the finished wall sections, on the lower end of the lift device.

2. A climbing shuttering system comprising:

a largely horizontally arranged support structure, on which a plurality of concrete shuttering elements are appended hanging downwards;

at least one first, upper support carrier, on which the support structure is supported, and having elements, by which the upper support carrier is vertically supportable by lateral contact between two completed wall sections which are spaced from each other;

at least one second, lower support carrier below the upper support carrier having elements on which the lower support carrier is vertically supportable by lateral contact between the two spaced and completed wall sections;

at least one lift device to provide a relative movement between the upper and the lower support carrier; wherein the upper support carrier is designed for support on a largely planar surface, so that the upper support carrier is positionable on such a surface, the upper support carrier is designed so that the shuttering elements are positionable to form a shuttering for at least two opposite wall sections on the largely planar surface, the upper support carrier is arrangeable between the shuttering elements which are in the shuttering position inside the wall sections which are to be formed, so that the shuttering elements are at least slightly movable in the horizontal direction with this arrangement of the support carrier, and the lower support carrier is mountable when the upper support carrier is supported on the finished wall sections, on the lower end of the lift device.

3. A climbing shuttering system according to claim 1, wherein the upper support carrier is provided with elements which are pivotable for lateral support around a largely horizontal axis and which are removably mountable to the upper support carrier.

4. A climbing shuttering system according to claim 1, wherein the shuttering elements are mounted to be lowered and raised on the support structure.

5. A climbing shuttering system according to claim 4, wherein the upper support carrier includes one or more sections laterally extendable into engagement with finished wall sections.

6. A climbing shuttering system according to claim 4, wherein the upper support carrier has elements which are pivotable for the lateral support around a largely horizontal axis and are arranged in an upper zone of support carrier so that the pivotable elements with the arrangement of the upper support carrier is pivotable on a planar surface and between the shuttering elements in the shuttering position.

7. A climbing shuttering system according to claim 1, wherein the support structure and at least one upper support carrier are connected to be height adjustable with each other.

* * * * *